US012593870B2

(12) United States Patent
Bouchuiguir et al.

(10) Patent No.: US 12,593,870 B2
(45) Date of Patent: Apr. 7, 2026

(54) AEROSOL GENERATION DEVICE WITH A MOVABLE PANEL FOR HIDING INTERFACES

(71) Applicant: JT International SA, Geneva (CH)

(72) Inventors: Layth Sliman Bouchuiguir, Bellevue (CH); Nathan Lyell, Woking (GB); Marko Plevnik, London (GB)

(73) Assignee: JT International SA, Geneva (CH)

( * ) Notice: Subject to any disclaimer, the term of this patent is extended or adjusted under 35 U.S.C. 154(b) by 671 days.

(21) Appl. No.: 17/912,289

(22) PCT Filed: Feb. 19, 2021

(86) PCT No.: PCT/EP2021/054200
§ 371 (c)(1),
(2) Date: Sep. 16, 2022

(87) PCT Pub. No.: WO2021/185530
PCT Pub. Date: Sep. 23, 2021

(65) Prior Publication Data

US 2023/0144523 A1 May 11, 2023

(30) Foreign Application Priority Data

Mar. 18, 2020 (EP) ..... 20164044

(51) Int. Cl.
*A24F 13/00* (2006.01)
*A24F 40/40* (2020.01)
(Continued)

(52) U.S. Cl.
CPC ..... *A24F 40/40* (2020.01); *A24F 40/85* (2020.01); *A24F 40/95* (2020.01)

(58) Field of Classification Search
CPC ..... A24F 47/00
(Continued)

(56) References Cited

U.S. PATENT DOCUMENTS 7,866,991 B2 * 1/2011 Liu ..... H05K 5/0221 439/138
2014/0266007 A1 * 9/2014 Li ..... H02J 7/0032 320/107
(Continued)

FOREIGN PATENT DOCUMENTS

CN 204146342 U 2/2015
CN 105326091 A 2/2016
(Continued)

OTHER PUBLICATIONS

International Search Report for Application No. PCT/EP2021/054200 mailed May 14, 2021, pp. 1-4.
(Continued)

*Primary Examiner* — Phuong K Dinh
(74) *Attorney, Agent, or Firm* — Lerner David LLP

(57) ABSTRACT

The invention relates to an aerosol generation device. In particular, the invention relates to an aerosol generation device with a panel for hiding one or more interfaces of the device, wherein the panel is movable and/or removable for exposing the one or more interfaces. An aerosol generation device comprises a housing that forms an exterior surface of the device, one or more interfaces, and a panel attached in a fixed position to the housing to conceal the one or more interfaces, and movable from the fixed position to expose the one or more interfaces to the outside of the device.

13 Claims, 5 Drawing Sheets

(51) Int. Cl.
*A24F 40/85* (2020.01)
*A24F 40/95* (2020.01)

(58) Field of Classification Search
USPC ..... 131/328–329
See application file for complete search history.

(56) References Cited

U.S. PATENT DOCUMENTS

| | | | | |
|---|---|---|---|---|
| 2017/0150755 | A1* | 6/2017 | Batista | H05B 1/0244 |
| 2018/0020734 | A1* | 1/2018 | Angstead | A24F 40/30 131/273 |
| 2018/0360125 | A1 | 12/2018 | James et al. | |
| 2019/0014823 | A1* | 1/2019 | Sur | A24F 40/50 |
| 2019/0166910 | A1 | 6/2019 | Eweidah | |
| 2021/0015176 | A1* | 1/2021 | Conner | A24D 1/22 |

FOREIGN PATENT DOCUMENTS

| | | | |
|---|---|---|---|
| CN | 207383540 | U | 5/2018 |
| CN | 208318223 | U | 1/2019 |
| EP | 3294077 | A1 | 3/2018 |
| WO | 2019084161 | A1 | 5/2019 |
| WO | 2019090415 | A1 | 5/2019 |
| WO | 2019170893 | A1 | 9/2019 |

OTHER PUBLICATIONS

Search Report dated Feb. 25, 2025 from the Office Action for Chinese Application No. 202180021460.0 issued Feb. 28, 2025, 3 pages.

* cited by examiner

AEROSOL GENERATION DEVICE WITH A MOVABLE PANEL FOR HIDING INTERFACES

CROSS-REFERENCE TO RELATED APPLICATIONS

The present application is a national phase entry under 35 U.S.C. § 371 of International Application No. PCT/EP2021/054200, filed Feb. 19, 2021, which claims priority to European Application No. 20164044.8, filed Mar. 18, 2020, the disclosures of which are incorporated herein by reference.

TECHNICAL FIELD

The invention relates to an aerosol generation device. In particular, the invention relates to an aerosol generation device with a panel for hiding one or more interfaces of the device, wherein the panel is movable and/or removable for exposing the one or more interfaces.

TECHNICAL BACKGROUND

Aerosol generation devices commonly have a device housing that comprises one or more interfaces for interacting with an outside of the device such as, among others, charging ports for a power source of the device, data communication ports for transferring and receiving data to and from the device, or access ports for accessing an inside of the device for, for example, cleaning purposes.

Aerosol generation devices are typically mobile devices that are transported by user in a user's hand, a bag, a shirt pocket, a trouser pocket, a jacket pocket or in similar transportation conditions. In this process, the aerosol generation device is subjected to dirt, debris, liquids and external forces that may damage the device or inadvertently cause incorrect operation of the device.

Leaving such interfaces exposed and unprotected to the outside and against external influences without any protection may result in these interfaces becoming dirty or damaged, leading to malfunctioning of the device or even irreversible damage to the device.

Therefore, there is a need for a device housing that offers improved protection against harmful external influences for the interfaces while providing reliable and convenient access to the interfaces.

SUMMARY OF THE INVENTION

The above objective is solved by the invention as defined by the features of the independent claims. Preferred embodiments of the invention are defined by the features of the dependent claims.

A first aspect of the invention is an aerosol generation device comprising a housing that forms an exterior surface of the device, one or more interfaces, and a panel attached in a fixed position to the housing to conceal the one or more interfaces, and movable from the fixed position to expose the one or more interfaces to the outside of the device. Concealing the one or more interfaces with a panel offers increased protection against harmful external influences. It should be noted that concealing means rendering the one or more interfaces not visible from the outside of the housing of the aerosol generation device. Provision of the panel in movable manner for exposing the interfaces provides easy and convenient access to the interfaces.

According to a second aspect, in the preceding aspect, the panel is guided to make a sliding and/or rotating movement between the fixed position and a second position different from the fixed position. The second position contributes to providing a reliable, reproducible, predictable and well-defined movement and thus behavior of the movable panel to facilitate correct operation of the movable panel by a user.

According to a third aspect, in the preceding aspect, the panel and/or the housing is provided with a first magnet configured to engage with the housing and/or panel, respectively, to define the fixed position, and/or a second magnet configured to engage with the housing and/or panel, respectively, to define the second position. The use of magnets is less susceptible to wear and tear and damage due to excessive or false operation of the panel than the use of, e.g., mechanical elements on the housing and panel configured to mechanically engage with each other.

According to a fourth aspect, in any one of the second or third aspects, the panel is detachable from the housing when it is in the second position, but not when it is in the fixed position. Allowing the panel to be detached from the housing facilitates repair or cleaning of the panel as well as the housing. Allowing detachment in the second position only prevents the panel from inadvertently being removed when the interfaces are concealed in the fixed position and ensures correct operation of the device and the panel.

According to a fifth aspect, in any one of second or third aspects, the panel is movable to a third position.

According to a sixth aspect, in the preceding aspect, the panel is detachable from the housing when it is in the third position, but not when it is in the fixed position and not when it is in the second position. The fifth and sixth aspects further improve safe and correct operation of the panel by separating a position for exposing the interfaces and a position for detaching the panel, thus preventing inadvertent detaching of the panel.

According to a seventh aspect, in any one of the fifth or sixth aspects, the panel and/or the housing is provided with a third magnet configured to engage with the housing and/or panel, respectively, to define the third position. This provides the same advantages as detailed for the third aspect.

According to an eighth aspect, in any one of the fifth to seventh aspects, the panel is movable to the third position from the fixed position.

According to a ninth aspect, in the preceding aspect, the panel is movable to the third position by sliding and/or rotating the panel in a direction opposite to the direction for moving the panel from the fixed position to the second position. This mode of operation of the panel for either exposing the interfaces or detaching the panel prevents inadvertent detaching of the panel and improves safe and correct operation of the device and the panel.

According to a tenth aspect, in any one of the fifth to seventh aspects, the panel is movable to the third position from the second position. Restricting movement to the third position to either start from the fixed position or the second position provides an even better-defined movement and thus behavior of the panel for either exposing the interfaces or detaching the panel, thus even further preventing inadvertent detaching of the panel and improving safe and correct operation of the device and the panel.

According to an eleventh aspect, in the first aspect, the panel is detachable from the housing in the fixed position. This provides a simple and cost-efficient manner for exposing the interfaces.

According to a twelfth aspect, in any one of the preceding aspects, the aerosol generation device comprises a light-emitting indicator which is concealed by the panel in the fixed position.

According to a thirteenth aspect, in in the preceding aspect and any one of the second to tenth aspects, the light-emitting indicator is exposed to the outside of the device in the second position and/or the or when the panel is detached from the housing from the second position. The light-emitting indicator may serve to provide information about an operational or functional state of the device, and/or may serve to indicate correct positioning of the panel in the second position to ensure safe and correct operation of the movable panel.

According to a fourteenth aspect, in the eleventh or twelfth aspects, the light-emitting indicator is exposed to the outside of the device when the panel is detached from the housing.

According to a fifteenth aspect, in any one of the twelfth to fourteenth aspects, the panel is provided with a light guide or a transparent or translucent element at a position corresponding to the light-emitting indicator when the panel is in the fixed position. This allows the light-emitting indicator to be visible to the exterior of the device while providing a protective element for the light-emitting indicator against external influences.

According to a sixteenth aspect, in any one of the preceding aspects, the housing is provided with a safety vent for a battery provided within the housing, which is concealed by the panel in the fixed position.

According to a seventeenth aspect, in the preceding aspect and anyone of the second to tenth aspects, the safety vent is exposed to the outside of the device in the second position.

According to an eighteenth aspect, in the eleventh and sixteenth aspects, the safety vent is exposed to the outside of the device when the panel is detached from the housing.

Providing a safety vent according to any one of the sixteenth to eighteenth aspects increases the safety of a user in case of malfunctioning of a battery, in particular lithium ion batteries, that may be provided as a power source in the aerosol generation device.

According to a nineteenth aspect, in any one of the preceding aspects, the one or more interfaces are the only interfaces on the housing that are capable of interacting with the outside of the device. This ensures that all interfaces provided on the device are protected by the panel.

According to a twentieth aspect, in any one of the preceding aspects, the one or more interfaces include an electrical interface for charging a battery of the device and/or a communication interface for data transmission.

According to a twenty-first aspect, in any one of the preceding aspects, the one or more interfaces include an access port which allows access to an internal structure of the housing. Providing access to an internal structure of the housing facilitates any maintenance or repairs of the device.

According to a twenty-second aspect, in the preceding aspect, the internal structure is a chamber for generating aerosol from an aerosol generation substrate, and the access port is suitable for allowing the chamber to be cleaned. Allowing the chamber to be cleaned and maintained ensures correct functioning of the aerosol generation device.

According to a twenty-third aspect, in the preceding aspect, the access port functions as an air inlet for the chamber when in use. This reduces manufacturing costs as well as manufacturing complexity since the need for an additional air inlet is removed.

According to a twenty-fourth aspect, in any one of the preceding aspects, the housing is provided with an opening for discharging the generated aerosol to the outside of the device and an associated closing mechanism for the opening, and the housing and the panel form a seamless outer surface of the device, with the exception of a boundary between the housing and the panel, the opening, and the associated opening and closing mechanism. The closing mechanism for the opening for discharging generated aerosol prevents ingress of any unwanted particles and substances into the device when not in use, thereby further protecting the device against harmful external influences. By reducing the amount of seams between different parts of the device and the device housing, the amount of ingress points can be minimized, which further improves the protection of the device.

According to a twenty-fifth aspect, in any one of the preceding aspects, the shape of the panel essentially corresponds to the shape of the surface of the housing on one side of the housing.

According to a twenty-sixth aspect, in the preceding aspect, the size of the panel essentially corresponds to the size of the surface of the housing on one side of the housing.

According to a twenty-seventh aspect, in any one of the preceding claims, the fixed positions and/or the second position and/or the third position are predetermined positions. It should be noted that a predetermined position is a position that is defined in advance and prior to use of the aerosol generation device and in a clearly discernible manner. In other words, a predetermined position must be reproducible and cannot be the result of happenstance.

DETAILED DESCRIPTION OF PREFERRED EMBODIMENTS

Preferred embodiments of the present invention are described hereinafter and in conjunction with the accompanying drawings.

Figure 1:
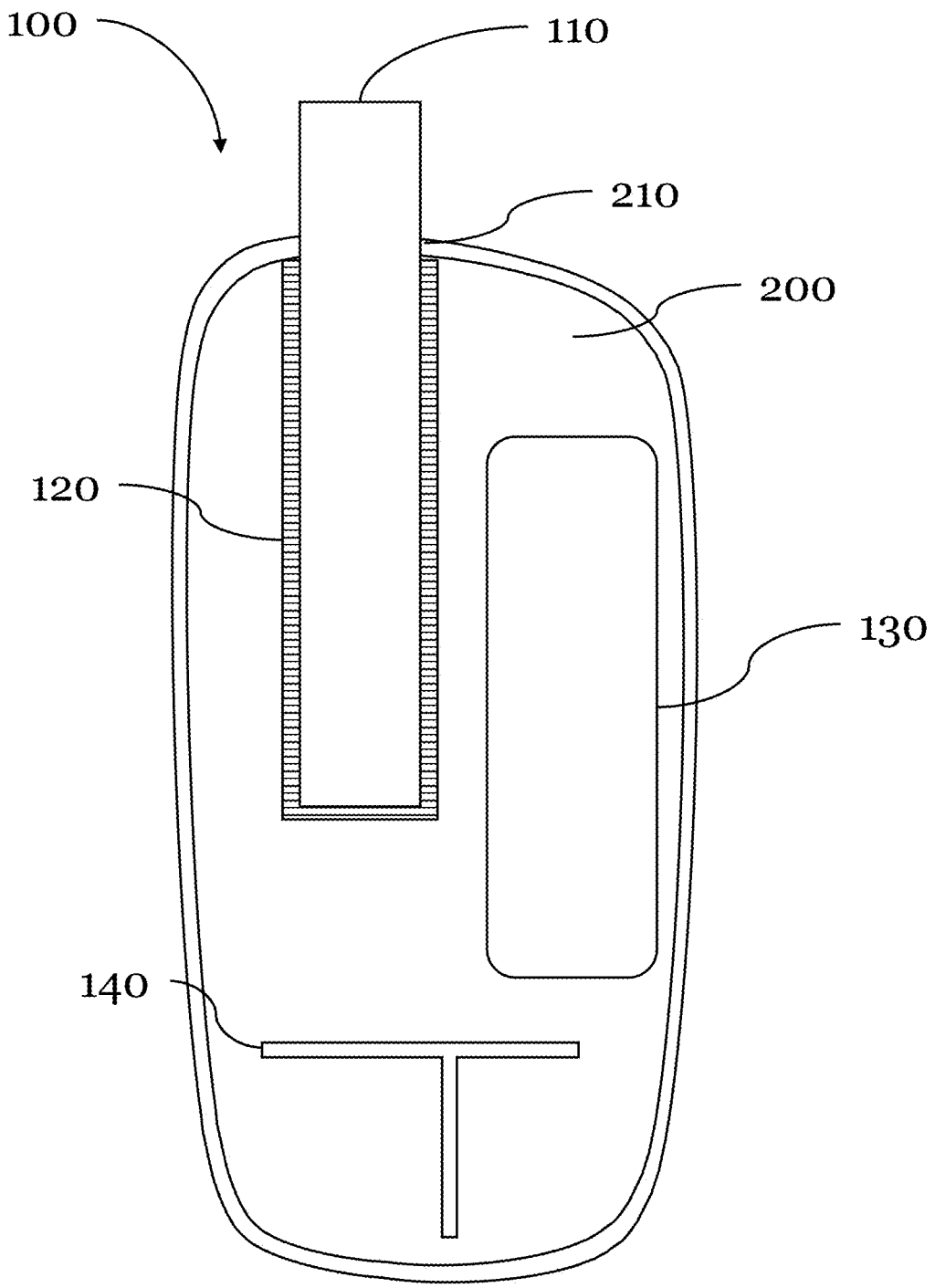
FIG. 1 shows a schematic illustration of an aerosol generation device according to embodiments of the invention.

An aerosol generation 100 as depicted in FIG. 1 commonly comprises a housing 200 with an opening 210 through which an aerosol generation substrate 110 such as a liquid or tobacco stick may at least partially be inserted into an aerosol generation chamber 120 of the device. The device 100 further comprises a power source 130 that may be a rechargeable and/or exchangeable power source such as a battery, and circuitry 140 for controlling operation of the aerosol generation device 100.

Figure 2A:
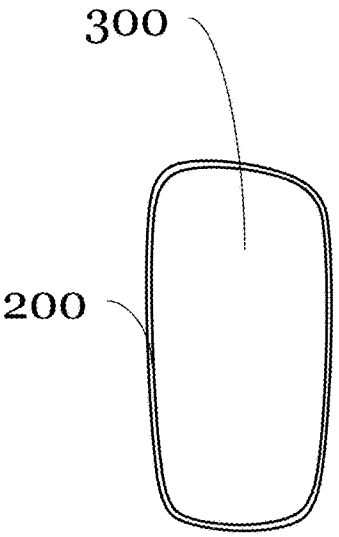
FIGS. 2A and 2B show schematic illustrations of a front view and a top view, respectively, of an aerosol generation device with the panel in the fixed position, according to embodiments of the invention.
Figure 2B:
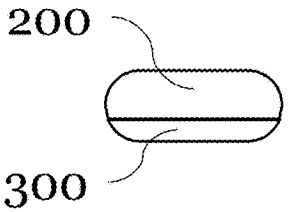

FIG. 2A shows a front view of an aerosol generation device comprising a housing 200 and a panel 300 attached to the housing 200 in the fixed position. While the panel 300 is depicted to have substantially the same size as a front surface of the housing 200, the panel 300 may be smaller in size such that is has only partially the size of a front surface of the housing 200. In the fixed position, all interfaces may be covered by the panel and are thus not visible and inaccessible from an outside of the aerosol generation device. In FIG. 2B, showing a top view of the aerosol generation device, it can be seen that the only seam runs between the housing 200 and the panel 300.

Figure 3C:
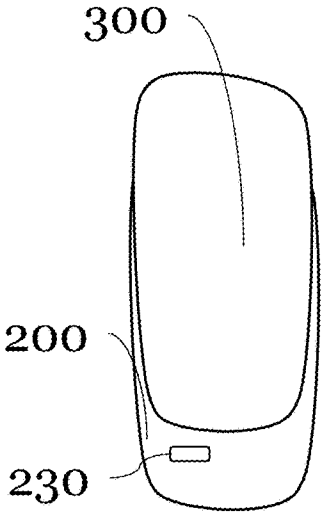
FIGS. 3A, 3B and 3C show schematic illustrations of a front view of an aerosol generation device with the panel in the second position, according to embodiments of the invention.
Figure 3B:
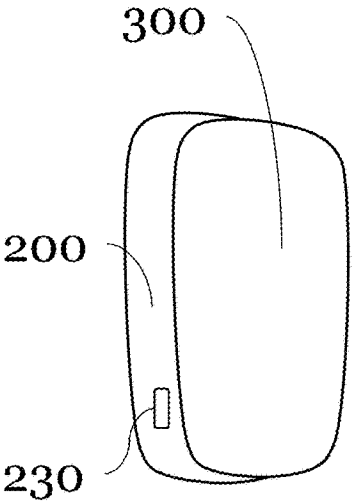
Figure 3A:
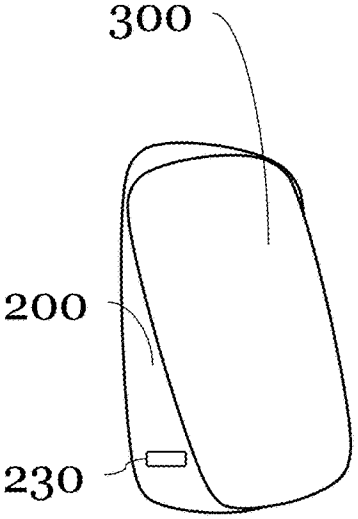

FIG. 3A shows an aerosol generation comprising a housing 200 and a panel 300 in the second position in which the panel 300 has made a rotational movement from a fixed position as shown in FIG. 2A. The rotational movement may be realized by, e.g., a swivel, rotating joint, or a similar configuration. The rotation exposes an interface 230 to an exterior of the device for interaction with the device. While the interface 230 is depicted as a single element, the interface 230 may comprise one or more of an electrical interface for charging a battery of the device, a communication interface for data transmission, an access port which allows access to an internal structure of the housing, wherein the access port preferably allows an internal aerosol generation chamber to be cleaned, and an air inlet. The housing 200 may also comprise a battery safety vent for releasing internal pressure in case of a malfunction of a battery that may be provided as a power source in the aerosol generation device. The panel 300 may remain attached to the housing 200 in the second position, or alternatively can be detachable from the housing 200 in the second position. Detaching the panel 300 may comprise moving the panel in a certain direction or further rotating the panel 300.

FIG. 3B shows an aerosol generation device that may be an aerosol generation device as described in the context of FIG. 3A. The panel 300 is in a second position in which the panel 300 has made a sideways sliding movement instead of a rotational movement. The sliding movement may be realized by the panel 300 being movably attached to the housing 200 by means of one or more protrusions and corresponding one or more grooves, provided on the housing and the panel or vice versa, and engaging with each other. FIG. 3C shows an aerosol generation device that may be an aerosol generation device as described in the context of FIGS. 3A and 3B. The panel 300 is in a second position in which the panel 300 has made an upwards sliding motion.

Figure 4B:
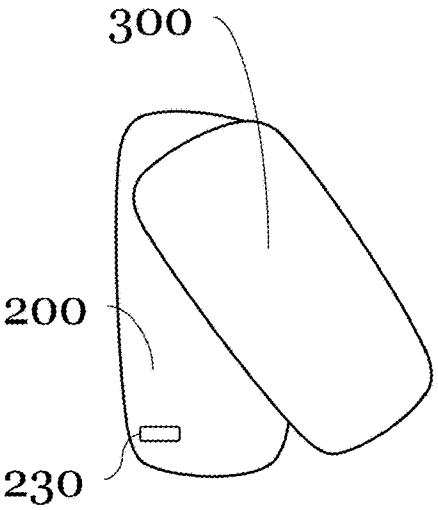
FIGS. 4A and 4B show schematic illustrations of a front view of an aerosol generation device with the panel in the second position and in the third position, respectively, according to embodiments of the invention.
Figure 4A:
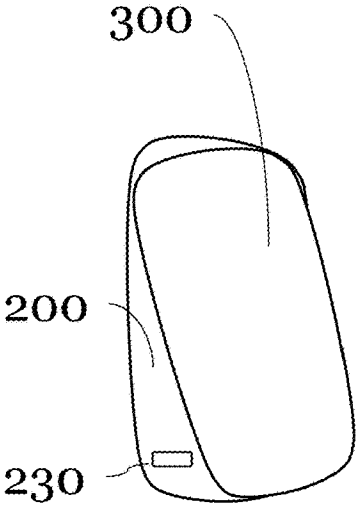

FIG. 4A shows an aerosol generation device that may be an aerosol generation device as described in the context of FIG. 3A. The panel 300 is in a second position in which the panel has made a rotational movement from the fixed position as shown in FIG. 2A to the second position. In the second position, the interface 230 is exposed and the panel 300 may not be detachable from the housing 200. FIG. 4B shows the panel 300 in the third position in which the panel 300 has made a further rotational movement from the second position in the same rotational direction as the rotational movement from the fixed position to the second position. In the third position, the panel 300 may be detached from the housing 200.

Figure 5B:
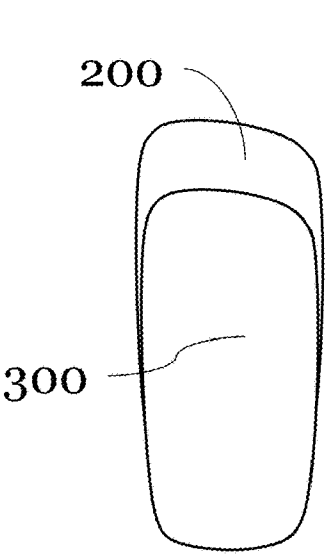
FIGS. 5A and 5B show schematic illustrations of a front view of an aerosol generation device with the panel in the second position and in the third position, respectively, according to embodiments of the invention.
Figure 5A:
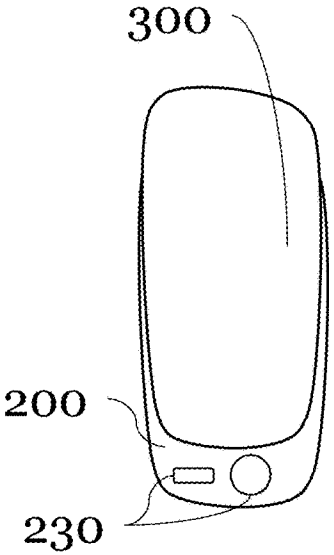

FIG. 5A shows an aerosol generation device that may be an aerosol generation device as described in the context of FIG. 3B. The panel 300 is in a second position in which the panel has made a sliding movement in an upwards direction from the fixed position as shown in FIG. 2A, to the second position. In the second position, the interface 230 is exposed and the panel 300 may not be detachable from the housing 200. FIG. 5B shows the panel 300 in the third position, in which the panel 300 has made a sliding movement in the direction opposite to the sliding motion from the fixed position to the second position. The panel 300 may move to the third position either directly by making a downward sliding motion from the fixed position, or may require the panel 300 to first be moved to the second position by making an upward sliding motion. In the third position, the panel 300 may be detached from the housing 200, and the interface 230 may or may not be exposed by the panel in the third position.

It should be noted that while the panel 300 is described in the above embodiments to be configured for making either a rotational movement or a sliding movement, the panel 300 may also be configured for making a combination of a sliding and a rotational movement. For example, the panel 300 may move to a second position by making a sliding movement, and move to a third position from either the second position or the fixed position by making a rotational movement. Alternatively, a movement may consist of a rotation and translation (sliding) at the same time.

Figure 6A:
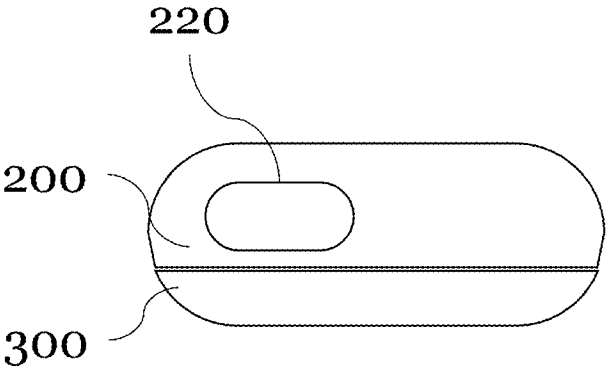
FIGS. 6A and 6B show schematic illustrations of a top view of an aerosol generation device with a closing mechanism, according to embodiments of the invention.
Figure 6B:
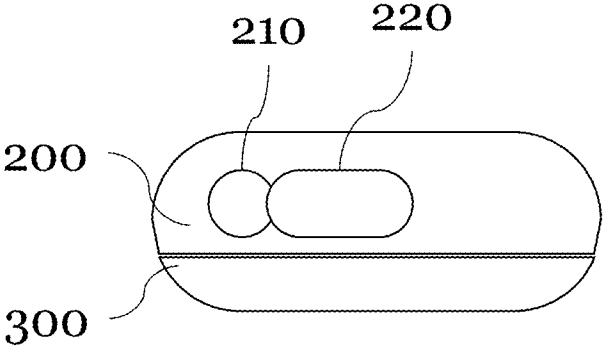

FIGS. 6A and 6B show a top view of an aerosol generation device, with a housing 200 comprising an opening 210 for discharging aerosol generated in the aerosol generation device using an aerosol generation substrate. The opening 210 may be provided with a closing and opening mechanism 220 to close off and protect the opening 210 when the aerosol generation device is not in use. The closing and opening mechanism 220 may be movable by a sliding movement or a rotational movement or a combination thereof. As further shown, the aerosol generation device comprises seams only between the housing 200, the opening 210, the closing and opening mechanism 220, and the panel 300.

Figure 7:
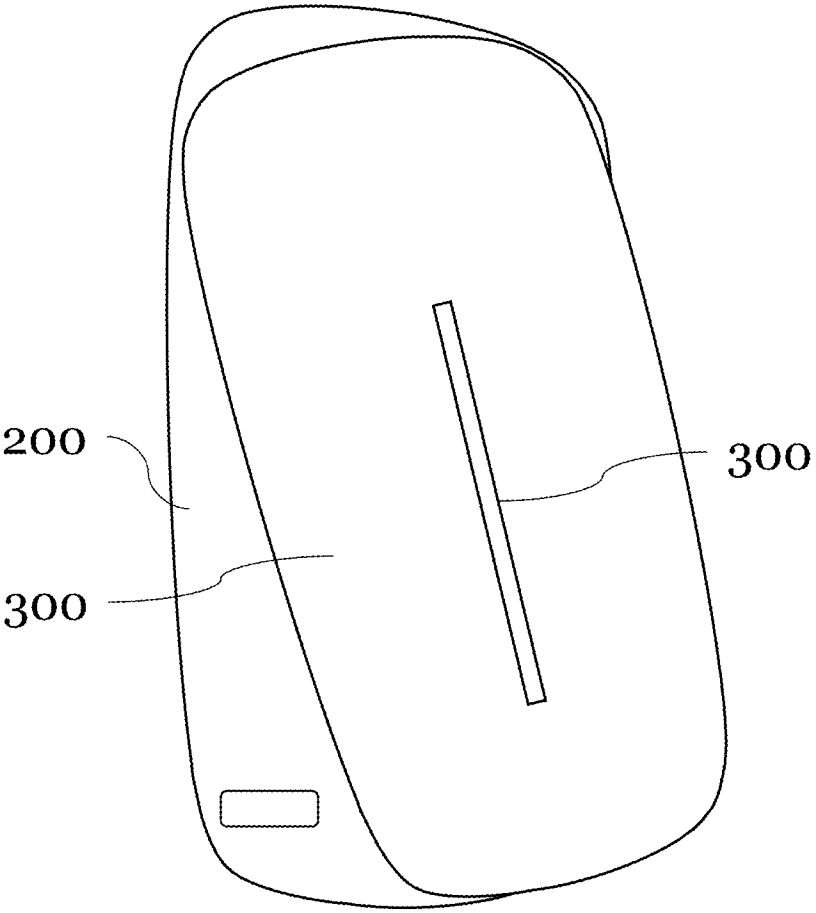
FIG. 7 shows a schematic illustration of a front view of an aerosol generation device with a light-guide, according to embodiments of the invention.

FIG. 7 shows an aerosol generation device that may be an aerosol generation as described in the context of any one of the preferred embodiments of the invention. While the aerosol generation device is shown to comprise a panel 300 that is in a second position relative to a housing 200 by making a rotational movement from the fixed position, in which the interface 230 is concealed, the panel may be configured to make a sliding movement or a combination of a rotational movement and a sliding movement, and the panel may further be moved to a third position. The panel 300 may comprise a light guide 320 provided on an outer surface of the panel 300. The housing may be provided with a light-emitting indicator that may only be visible by illuminating the light guide 320 when the panel is in the second position as shown in FIG. 7. The light-emitting indicator may be configured to indicate a technical state of the aerosol generation device, such as a charging status or level of a power source of the aerosol generation device. The light-emitting indicator may additionally, or alternatively, indicate that the panel 300 has correctly finished movement to the second position. Additionally, or alternatively, the housing may be provided with another light-emitting indicator that may only be visible when illuminating the light guide 320 when the panel 300 is in a third position different from the second position.

Figure 8B:
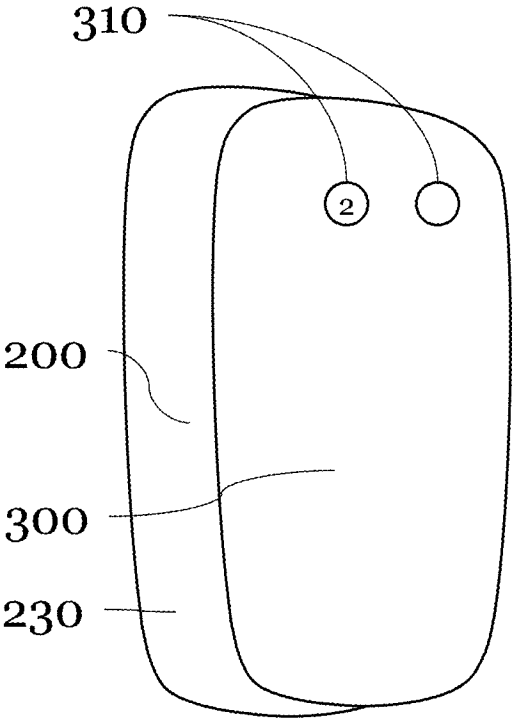
FIGS. 8A and 8B show schematic illustrations of a front view of an aerosol generation device comprising magnets, according to embodiments of the invention.
Figure 8A:
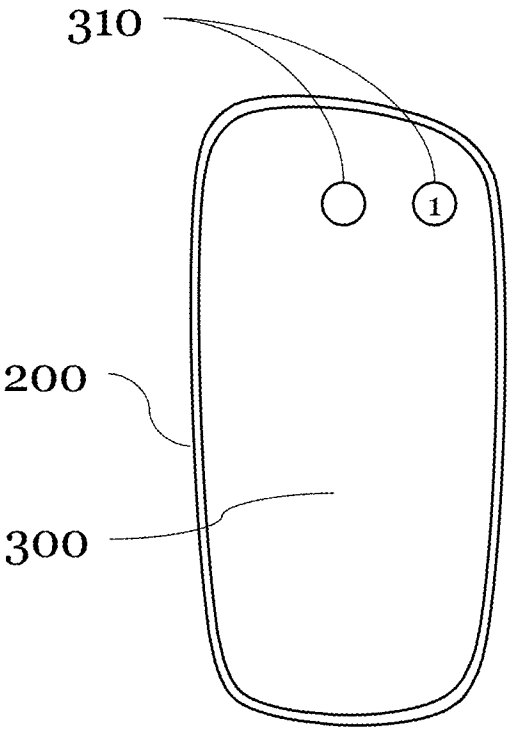

In any embodiment of the invention, as shown in FIGS. 8A and 8B, the aerosol generation device may have one or more magnets or magnetic elements 310 provided at the housing 200 and/or the panel 300 for defining the fixed position and the second position of the panel. In the fixed position as shown in FIG. 8A, the magnet 310 labelled "1" provided on the panel 300 couples with a metallic or magnetic positioning element provided on the housing 200 at a location corresponding to the location of the magnet 310 labelled "1". When the panel 300 is moved towards the second position, the magnet 310 labelled "2" engages with the metallic or magnetic positioning element provided on the housing. The panel 300 may be provided with a further magnet or magnetic element to define the position of a third position of the panel 300, to which the panel 300 is movable. Alternatively, the housing 200 may be provided with a magnetic positioning element and the panel 300 may be provided with one or more metallic elements instead of the magnets 310 that may engage with the magnetic positioning element provided on the housing to define the fixed position and/or the second position and/or the third position.

It should be noted that, in any of the embodiments described in the context of FIGS. 1 through 8B, the fixed position and/or the second position and/or the third position may be predetermined positions. A predetermined position is a position that is defined in advance, typically during manufacture and/or assembly of the aerosol generation device, typically prior to use of the aerosol generation device, and in a clearly discernible manner. In other words, a predetermined position is reliably reproducible and not the result of happenstance. For example, in case of a rotating or sliding movement of the panel 300, a predetermined position may be defined by a maximum rotation angle or sliding distance of the panel 300. For example, a sliding or rotating mechanism may be configured to allow a maximum sliding distance or rotation angle in a first sliding and/or first rotation direction and/or in a second sliding and/or second rotation direction opposite the first sliding and/or rotation direction. Such a maximum sliding distance or rotation angle may be inherently defined by the sliding or rotation mechanism provided or may be achieved by means of stopping or restrictive element. Additionally, or alternatively, a predetermined position may be a position that is defined by an attraction of the predetermined position causing the panel 300 to remain in the predetermined position once the panel 300 is in the predetermined position. In other words, a force required to cause the panel 300 to leave the predetermined position is substantially larger than a force required to cause movement of the panel 300 once the panel 300 has left the predetermined position. For example, a predetermined position may be defined by an attractive or restrictive element provided at the housing 200 cooperating with a respective cooperating element respectively provided at the panel 300. As a non-limiting example, the housing 200 may be provided with a magnetic coupling element and the panel 300 may be provided with a magnetic counter-coupling element, and a predetermined position is defined as a position in which the magnetic coupling element interacts with the magnetic counter-coupling element in an attractive coupling state. As another non-limiting example, the housing 200 may be provided with a groove or dimple or similar element, and the panel 300 may be provided with a cooperating protrusion or similar element, or vice versa, and a predetermined position is defined as a position in which the cooperating protrusion interacts with the groove or dimple. The cooperating protrusion interacting with the groove or dimple may comprise the cooperation protrusion being positioned in the groove or dimple. It should be noted that a plurality and any combination of the above described means for defining a predetermined position may be employed.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the scope of this disclosure, as defined by the independent and dependent claims.

LIST OF REFERENCE SIGNS USED

100: aerosol generation device
110: aerosol generating substrate
120: aerosol generation chamber
130: power supply
140: circuitry
200: device housing
210: opening
220: closing and opening mechanism
230: interface
300: panel
310: magnet
320: light guide

The invention claimed is:

1. An aerosol generation device comprising:
a housing that forms at least part of an exterior surface of the device;
one or more interfaces; and
a panel attached in a fixed position to the housing, to conceal the one or more interfaces, and movable from the fixed position to expose the one or more interfaces to an outside of the device,
wherein the panel is guided to make a sliding and/or rotating movement between the fixed position and a second position different from the fixed position, and
wherein the panel and/or the housing is provided with a magnet configured to engage with the housing and/or panel, respectively, to define the second position.

2. The aerosol generation device according to claim 1, wherein the panel and/or the housing is further provided with
a first magnet configured to engage with the housing and/or panel, respectively, to define the fixed position.

3. The aerosol generation device according to claim 1, wherein the panel is movable to a third position.

4. The aerosol generation device according to claim 3, wherein the panel is movable to the third position from the fixed position, or
wherein the panel is movable to the third position from the second position.

5. The aerosol generation device according to claim 4, wherein the panel is movable to the third position by sliding and/or rotating the panel in a direction opposite to a direction that moves the panel from the fixed position to the second position.

6. The aerosol generation device according claim 1, comprising a light-emitting indicator which is concealed by the panel in the fixed position.

7. The aerosol generation device according to claim 6, wherein the light-emitting indicator is exposed to the outside of the device in the second position and/or when the panel is detached from the housing from the second position.

8. The aerosol generation device according to claim 6, wherein the panel is provided with a light guide or a transparent or translucent element at a position corresponding to the light-emitting indicator when the panel is in the fixed position.

9. The aerosol generation device according to claim 1, wherein the housing is provided with a safety vent for a battery provided within the housing, which is concealed by the panel in the fixed position.

10. The aerosol generation device according to claim 1, wherein the one or more interfaces include an electrical interface for charging a battery of the device and/or a communication interface for data transmission.

11. The aerosol generation device according to claim 1, wherein the one or more interfaces include an access port which allows access to an internal structure of the housing.

12. The aerosol generation device according to claim 1, wherein the housing is provided with an opening for discharging generated aerosol to the outside of the device and an associated closing mechanism for closing the opening, and the housing and the panel form a seamless outer surface of the device, with the exception of a boundary between the housing and the panel, and the associated closing mechanism when the opening is closed.

13. An aerosol generation device comprising:

a housing that forms at least part of an exterior surface of the device;

one or more interfaces; and a panel attached in a fixed position to the housing, to conceal the one or more interfaces, and movable from the fixed position to expose the one or more interfaces to the outside of the device, wherein the housing is provided with a safety vent for a battery provided within the housing, which is concealed by the panel in the fixed position.

* * * * *